US006401502B1

(12) United States Patent
Yang

(10) Patent No.: US 6,401,502 B1
(45) Date of Patent: Jun. 11, 2002

(54) MULTIPURPOSE CABLE LOCK

(75) Inventor: Kuo Tsung Yang, Taipei (TW)

(73) Assignee: Jin Tay Industries Co., Ltd., Taipei Hsien (TW)

( * ) Notice: Subject to any disclaimer, the term of this patent is extended or adjusted under 35 U.S.C. 154(b) by 0 days.

(21) Appl. No.: 09/852,546

(22) Filed: May 8, 2001

(51) Int. Cl.[7] ..... E05B 37/06
(52) U.S. Cl. ..... 70/30; 70/14; 70/58
(58) Field of Search ..... 70/14, 30, 49, 70/57, 58, 423–428, 312, 18

(56) References Cited

U.S. PATENT DOCUMENTS 3,435,642 A * 4/1969 Del Pesco ..... 70/49
3,785,183 A * 1/1974 Sander ..... 70/58
3,859,826 A * 1/1975 Singer et al. ..... 70/58
4,325,238 A * 4/1982 Scherbing ..... 70/49 X
4,570,465 A * 2/1986 Bennett ..... 70/58
4,970,883 A * 11/1990 Johnson ..... 70/30
5,119,649 A * 6/1992 Spence ..... 70/14
5,327,752 A * 7/1994 Myers et al. ..... 70/58
5,351,507 A * 10/1994 Derman ..... 70/58
5,701,769 A * 12/1997 Hall ..... 70/14 X
5,709,110 A * 1/1998 Greenfield ..... 70/58
5,752,416 A * 5/1998 Nien ..... 70/49
5,794,463 A * 8/1998 McDaid ..... 70/18
5,823,020 A * 10/1998 Benda ..... 70/18
5,875,657 A * 3/1999 Kelley ..... 70/18
5,913,907 A * 6/1999 Lee ..... 70/58
5,937,678 A * 8/1999 Kuo ..... 70/49 X
5,983,679 A * 11/1999 Reyes ..... 70/58
5,992,187 A * 11/1999 Derman ..... 70/58
6,006,555 A * 12/1999 Shu-Fen ..... 70/18
6,006,557 A * 12/1999 Carl et al. ..... 70/58
6,105,922 A * 8/2000 Derman ..... 70/58 X
5,560,232 A * 12/2000 Murray, Jr. et al. ..... 70/58
6,173,591 B1 * 1/2001 Derman ..... 70/58
6,199,413 B1 * 3/2001 McDaid et al. ..... 70/58
6,205,824 B1 * 3/2001 Miao ..... 70/58
6,212,918 B1 * 4/2001 Kravtin ..... 70/14
6,212,922 B1 * 4/2001 Miao ..... 70/58
6,227,017 B1 * 5/2001 Igelmund ..... 70/58
6,244,080 B1 * 6/2001 Sakurai ..... 70/14
6,244,082 B1 * 6/2001 Avganim ..... 70/58
6,257,029 B1 * 7/2001 Liao ..... 70/58
6,263,711 B1 * 7/2001 Kuo ..... 70/49 X

* cited by examiner

*Primary Examiner*—Suzanne Dino Barrett
(74) *Attorney, Agent, or Firm*—Rosenberg, Klein & Lee

(57) ABSTRACT

A multipurpose cable lock is provided where one end of a cable joins a lock body. The other end of the cable joins a mobile stopper head. The main body of the mobile stopper head has an annular groove. The bottom face of the main body has a raised portion embedded into a groove of the lock body. The main body of a locking stopper head has an annular groove. Two locking feet having hook heads are joined in the main body. An axial stopper is used to unfold and fold the locking feet. The axial stopper has a raised head embedded in the groove of the lock body. An adjusting stopper head is slipped on the cable. The adjusting stopper head joins a bushing through a pin. The center of the bushing is screwed to a locating shaft capable of moving axially to press on the cable.

9 Claims, 8 Drawing Sheets

MULTIPURPOSE CABLE LOCK

FIELD OF THE INVENTION

The present invention relates to a multipurpose cable lock and, more particularly, to a structure having locking devices such as a mobile stopper head, an adjusting stopper head, and a locking stopper head matched in a lock body to pass through and be wound around an article for locating it.

BACKGROUND OF THE INVENTION

There are many cases that notebook computers are taken away unintentionally or stolen purposely by other people, hence losing important data. Most notably, the notebook computer responsible for the U.S. nuclear war plan had been stolen for several months. This is because there is no tool for locking a notebook computer at a specific position. Because notebook computers having good portability have smaller and smaller volumes, and their functions are similar to those of desktop computers, more and more people start to use them as portable articles.

However, owners cannot guard their notebook computers all the time. No matter at work or in commuting vehicles, stations, and airports, a notebook computer should have locking function. Therefore, a burglarproof device for a notebook computer is needed. Additionally, there are always some burglars wanting to steal personal luggage or computers or displays disposed in public places. The present invention aims to solve the above problems in the prior art.

SUMMARY OF THE INVENTION

The primary object of the present invention is to provide a multipurpose cable lock mainly used to lock and connect luggage, wherein a cable can pass through an article to be locked and wind around the present invention at a specific position so as to form a fixed structure. A protection structure of personal luggage is thus formed to prevent important articles from being stolen.

Another object of the present invention is to provide the above multipurpose cable lock capable of fixing a notebook computer on a desk or at a specific position, wherein a special locking stopper head is locked and connected with the notebook computer from an axial stopper by a pair of locking feet, thereby being easily fastened with a lock head. Similarly, a cable is slipped on a fixed structure to prevent the computer from being stolen.

Yet another object of the present invention is to provide a multipurpose cable lock, wherein a third locking device for joining is added on a cable in addition to a locking stopper head and a mobile stopper head. The third locking device is an adjusting stopper head, which is different from the mobile stopper head in that the mobile stopper head is restricted at the tail end of the cable, while the adjusting stopper head can be fixed at any position of the cable because of its special structure. That is, the adjusting stopper head can be located between a lock body of the cable and a locking device of cable head, hence achieving arbitrary locating function on the cable. Moreover, restricting function can be achieved with a cable of the shortest length.

Still yet another object of the present invention is to provide the above multipurpose cable lock, whereby locating effect of the adjusting stopper head, the locking stopper head, and the mobile stopper head with the lock body can be improved. A raised portion is formed on the bottom face of the above three heads, and a groove is disposed on the lock body, thereby forming an embedding mechanism to prevent the adjusting stopper head, the locking stopper head, and the mobile stopper head from sliding out from the lock body. Therefore, it will be much more difficult to destroy the present invention and then steal the article locked by the present invention.

To achieve the above objects, the structure of the present invention is described below. One end of a cable joins a lock body. The other end of the lock body has a locking stopper. The outer end of the locking stopper joins a bottom locking edge, and the lock body has a top locking edge thereon. The other end of the cable is wound back to form a ring part. The ring part joins a mobile stopper head. The mobile stopper head has an ear hole to be passed through by the cable. The mobile stopper head has a disk-shaped main body with an annular groove at the periphery thereof. The annular groove can be locked between the top and bottom locking edges of the lock body. The bottom face of the main body has a raised portion embedded into a groove on an end face of the lock body.

A locking stopper head for locking a notebook computer is also provided. The locking stopper head has a disk-shaped main body with an annular groove at the periphery thereof. The annular groove can be locked between the top and bottom locking edges of the lock body. The main body has a pair of locking feet therein. The locking foot has a hook head to stick into a fixing hole of a computer housing. The other end of the locking foot is joined in the main body. An axial stopper is used to let the locking foot unfold and be locked. The axial stopper has a raised head to be embedded into the groove on an end face of the lock body.

The cable passes through an adjusting stopper head. The adjusting stopper head has a main body. One end of the main body has an ear hole to be passed through by the cable. The other end of the main body has a bushing seat so that the inner end of a bushing can be embedded therein. The periphery of the inner end of the bushing has a locating annular groove. A pin is inserted into the locating annular groove from the main body to let the bushing not slide out.

The center of the bushing has an inner thread to be screwed to an outer thread at the middle section of a locating shaft capable of moving axially. When the bushing is turned, the inner end of the locating shaft will press on the cable, and the periphery of the adjusting stopper head will form an annular groove to be fastened between the top and bottom locking edges of the lock body. The outer end of the locating shaft is embedded into the groove on an end face of the lock body.

The various objects and advantages of the present invention will be more readily understood from the following detailed description when read in conjunction with the appended drawing, in which:

DETAILED DESCRIPTION OF THE PREFERRED EMBODIMENTS

Figure 1:
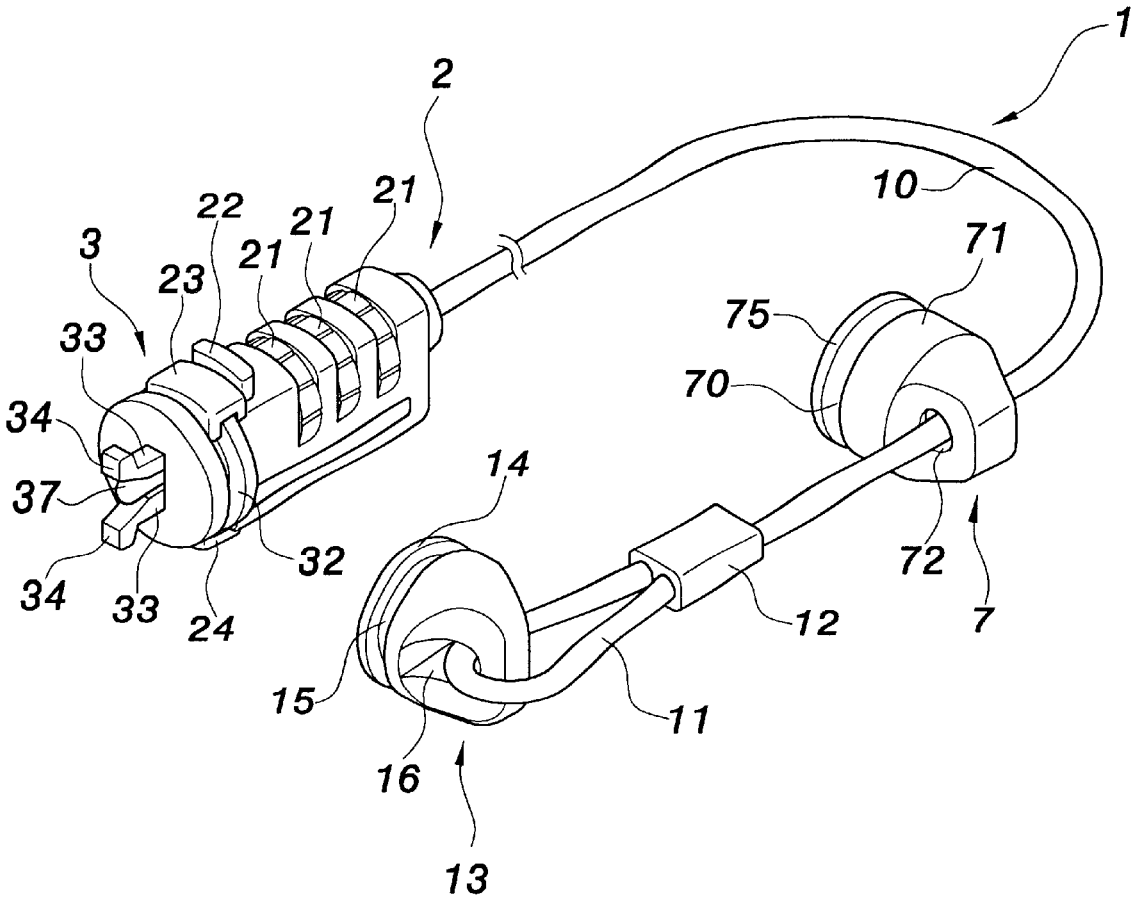
FIG. 1 is a perspective view of the present invention.

As shown in FIG. 1, in a multipurpose cable lock 1 of the present invention, one end of a cable 10 joins a lock body 2. The lock body 2 has at least a numeral rings 21 thereon. The other end of the lock body 2 has a locking stopper 22. The outer end of the locking stopper 22 joins a bottom locking edge 24. A top locking edge 23 is correspondingly disposed on the lock body 2. The other end of the cable 10 is wound back to form a ring portion 11, which is formed by astringing the cable 10 using a cable head gripper 12. In this embodiment a numeral lock is used for illustration, but a key lock can also be used.

Figure 4:
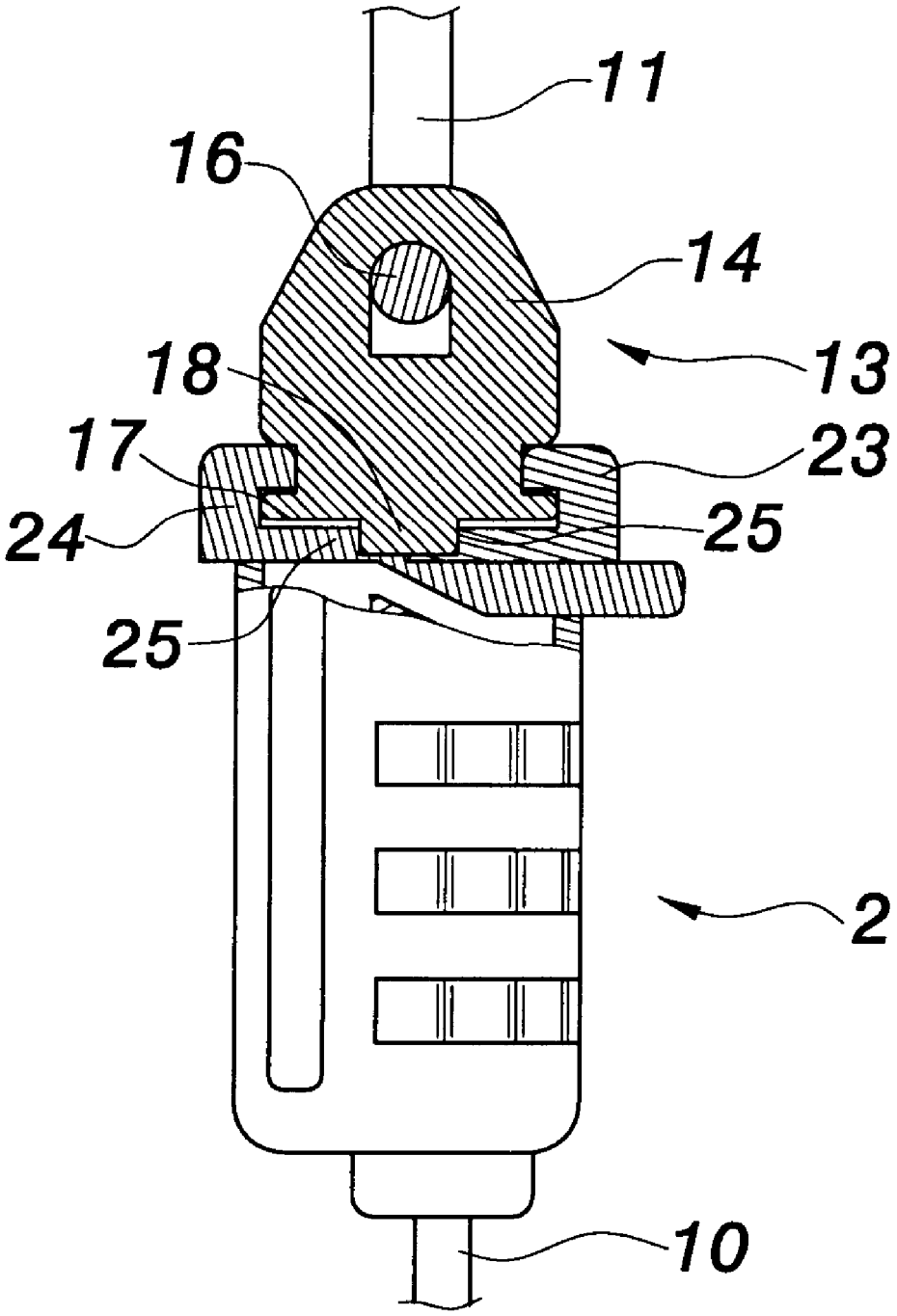
FIG. 4 is a partial cross-sectional view of the present invention when joining a mobile stopper head.

As shown in FIGS. 1 and 4, the ring portion 11 joins a mobile stopper head 13. The mobile stopper head 13 has an ear hole 16 to be passed through by the cable 10 at the ring portion 11. The mobile stopper head 13 has a disk-shaped main body 14 with an annular groove 15 at the periphery thereof. The annular groove 15 can be fastened between the top locking edge 23 and the bottom locking edge 24 of the lock body 2. A bottom face 17 of the main body 14 has a raised portion 18 matched and embedded in a groove 25 disposed on the lock body 2. It is also feasible that the raised portion 18 and the groove 25 are not provided. The mobile stopper head is a locking device. The locking devices also include an adjusting stopper head and a locking stopper head described below.

Figure 2:
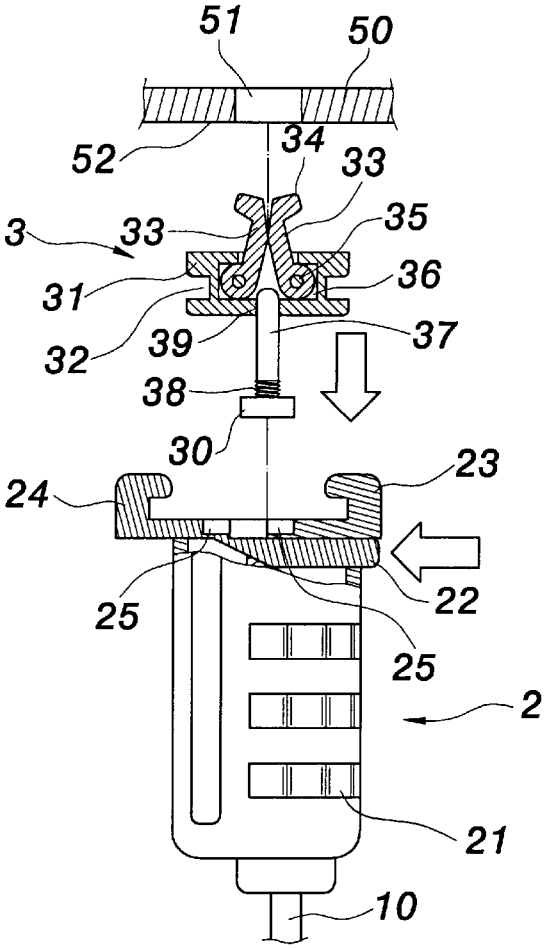
FIG. 2 is a partial exploded cross-sectional front view of the present invention when joining a locking stopper head.
Figure 3:
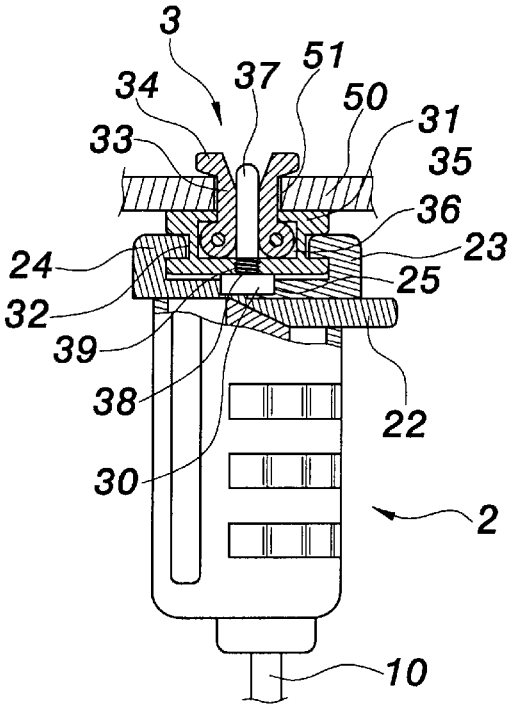
FIG. 3 is a partial cross-sectional front view of the present invention when joining a locking stopper head.

As shown in FIGS. 1 to 3, a locking stopper head 3 is further provided specially for locking and connecting a notebook computer. The locking stopper head 3 has a disk-shaped main body 31 with an annular groove 32 at the periphery thereof. The annular groove 32 can be fastened between the top and bottom locking edges 23 and 24. One end face of the main body 31 has a pair of locking feet 33. The lock foot 33 has a hook head 34 to stick into a fixing hole 51 of a computer housing 50. The other end of the locking foot 33 is joined in the main body 31 and forms a pivot 35 at one side of a swing room 36 in the main body 31. The pivot 35 is pivotally joined in the swing room 36 of the main body 31 through a short pin. An axial stopper 37 is used to let the pair of locking feet 33 unfold and lock or fold and release. The bottom face of the axial stopper 37 forms a raised head 30 to be embedded in the groove 25 on one end face of the lock body 2.

The pair of locking feet 33 are L-shaped. A V-shaped opening forms between the backs of the two hook heads 34. The axial stopper 37 has an outer thread portion 38 thereon to join an inner thread region 39 at the center of the main body 31. When the axial stopper 37 is squeezed into the main body 31, the two locking feet 33 will swing outwards and let the outer thread portion 38 be screwed to the inner thread region 39. Because the hook heads 34 are exactly inserted into the fixing hole 51 correspondingly disposed on the computer housing before the locking feet are pressed to unfold, the two hook heads 34 will unfold and be exactly locked in the fixing hole 51, hence connecting the locking stopper head 3 to the computer. The lock body 2 is then used to lock and connect the locking stopper head 3. That is, the locking stopper 22 is retracted to let the top locking edge 23 move toward the bottom locking edge 24 so that the pair of locking edges 23 and 24 are embedded into the annular groove 32. When the locking stopper 22 is pressed, the locking edge 24 is moved to release the locking state.

Figure 8:
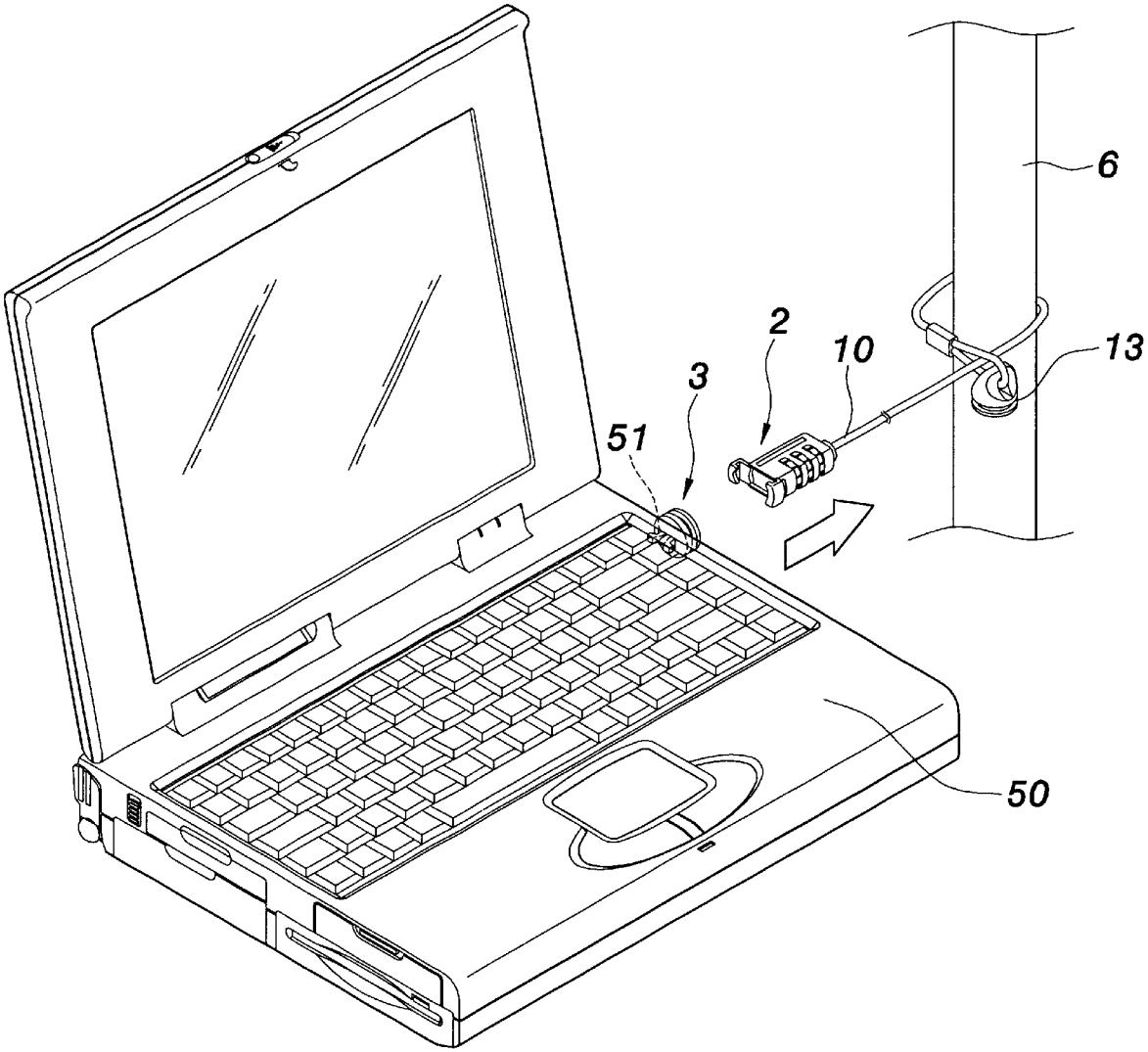
FIG. 8 is a perspective view of the present invention using a locking stopper head to lock a computer.

FIG. 8 shows the state of the locking stopper head 3 of the present invention embodied in the locking hole 51 of the computer. After the cable 10 passes through the ring portion 11, it is then slipped on a post 6 to join the lock body 2 with the locking stopper head 3.

Figure 5:
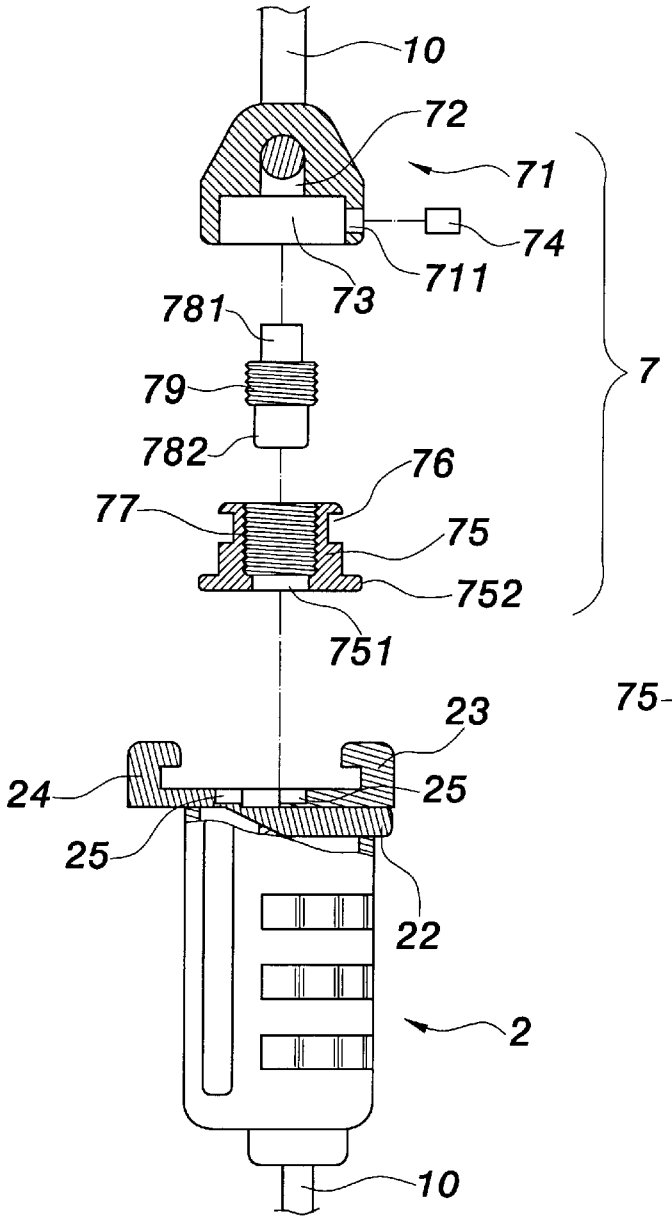
FIG. 5 is a partial exploded cross-sectional view of an adjusting stopper head of the present invention.
Figure 6:
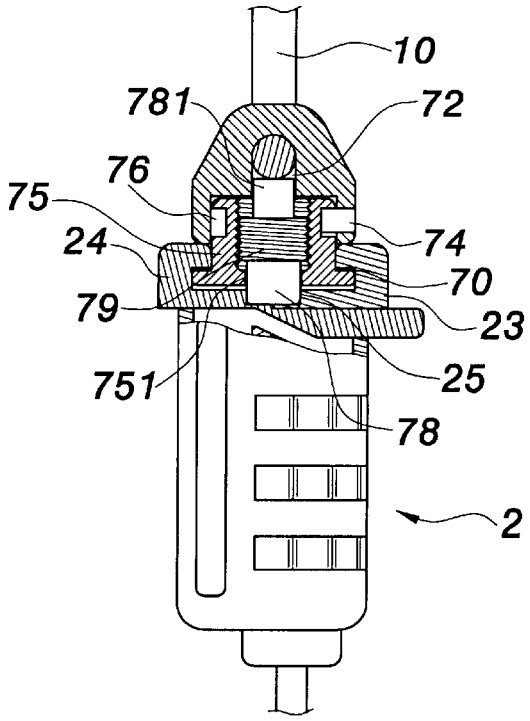
FIG. 6 is a partial cross-sectional side view of FIG. 5.

As shown in FIGS. 1, 5, and 6, the cable 10 passes through an adjusting stopper head 7. The adjusting stopper head 7 has a main body 71. One end of the main body 71 has an ear hole 72 to be passed through by the cable 10. The other end of the main body 71 has a bushing seat 73 connected with the ear hole 72. The inner half section of a bushing 75 is embedded in the bushing seat 73. The peripheral face of the inner half section of the bushing 75 has a locating annular groove 76. A pin 74 is inserted into a hole 711 on the peripheral face of the main body 71 to fix the locating annular groove 76 of the bushing 75 so that the bushing 75 will not slide out and can be turned.

The center of the bushing 75 has an inner thread 77 to be screwed to an outer thread 79 at the middle section of a locating shaft 78 capable of moving axially. When an exposed ring edge 752 at the bottom end of the outer half section of the bushing 75 is turned, the bushing 75 can rotate continually to let an inner end 781 of the locating shaft 78 rotate and move inwards and press on the cable 10 situated at the ear hole 72 so that the cable 10 will be pressed and cannot move. The side face of the adjusting stopper head 7 forms an annular groove 70. The annular groove 70 is situated between the bottom end face of the main body 71 and the ring edge 752 of the bushing 75 and can be fastened between the top and bottom locking edges 23 and 24 of the lock body 2.

Figure 7:
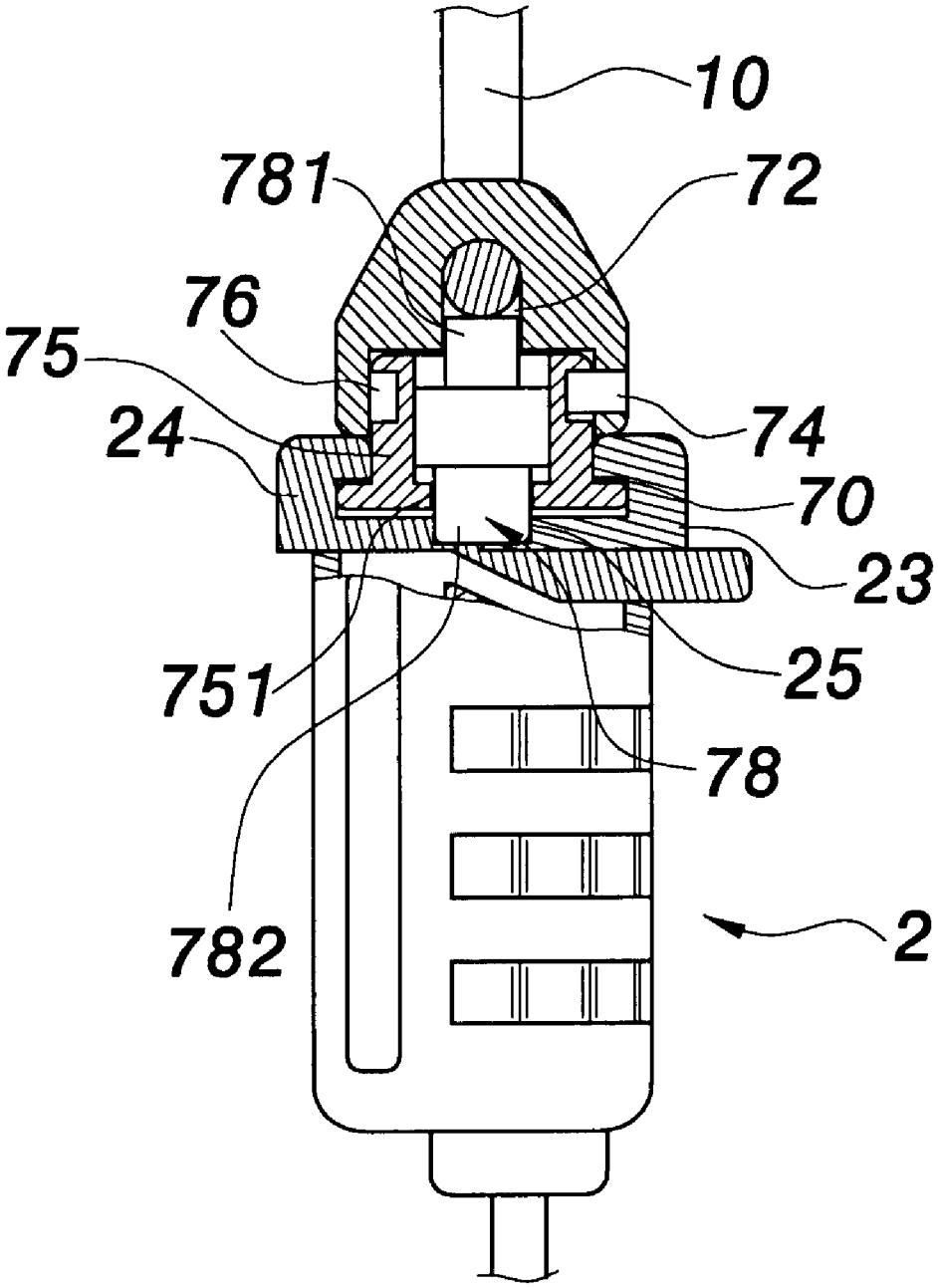
FIG. 7 is a partial cross-sectional side view of an adjusting stopper head of the present invention.

An outer end 782 of the locating shaft 78 passes through a central hole 751 of the bushing 75 and then is embedded in the groove 25 on one end face of the lock body 2. Thereby, the length of the cable can be adjusted more easily. Moreover, because the adjusting stopper head is fixed on the lock body and cannot be wrenched to detach from the lock body, high fixing capability and safety of use can be obtained. FIG. 7 shows another simple embodiment having the same effect, wherein the bushing has no inner thread and the locating shaft has no outer thread.

Figure 9:
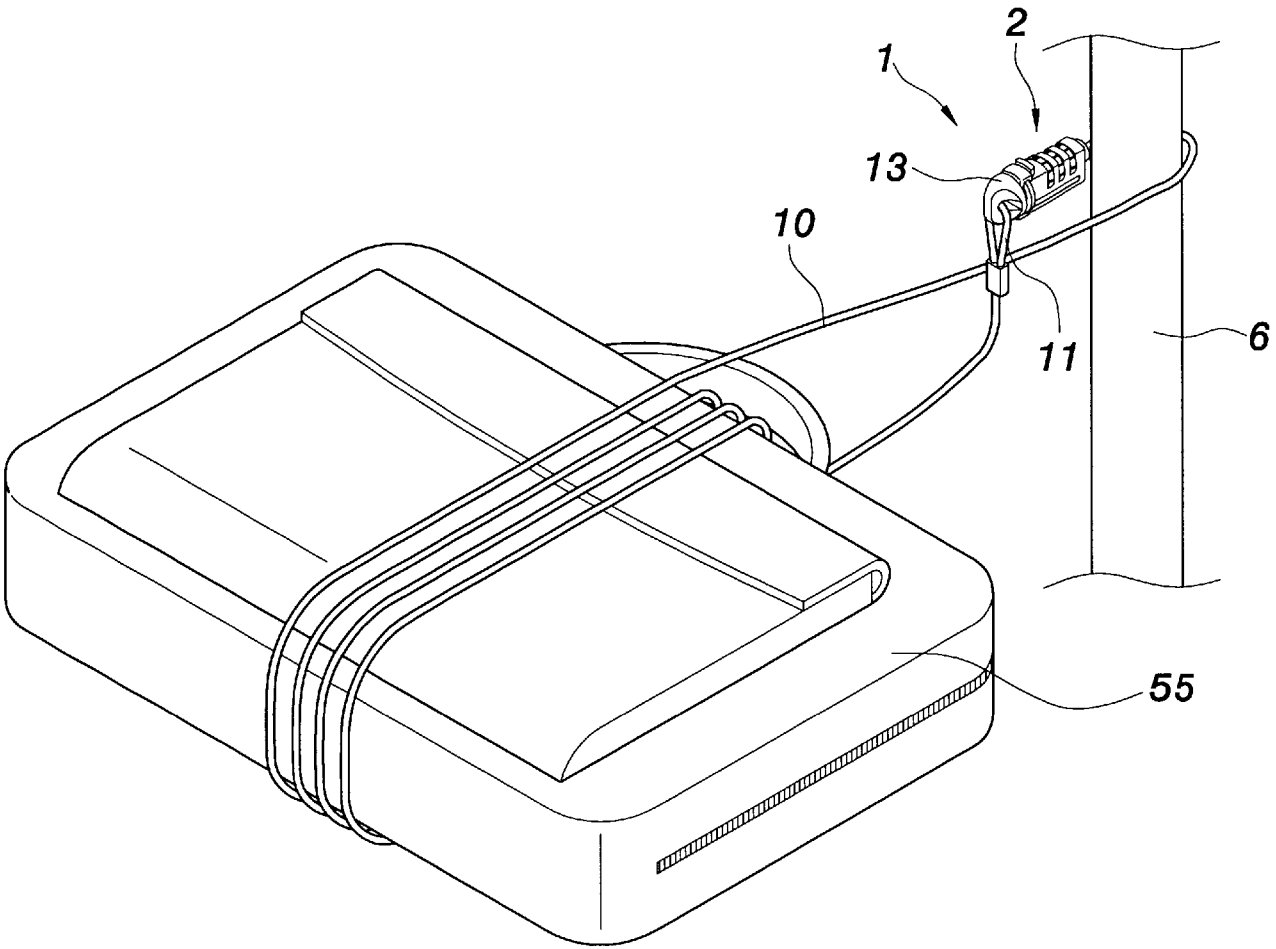
FIG. 9 is a perspective view of the present invention using a mobile stopper head to lock a bag.
Figure 10:
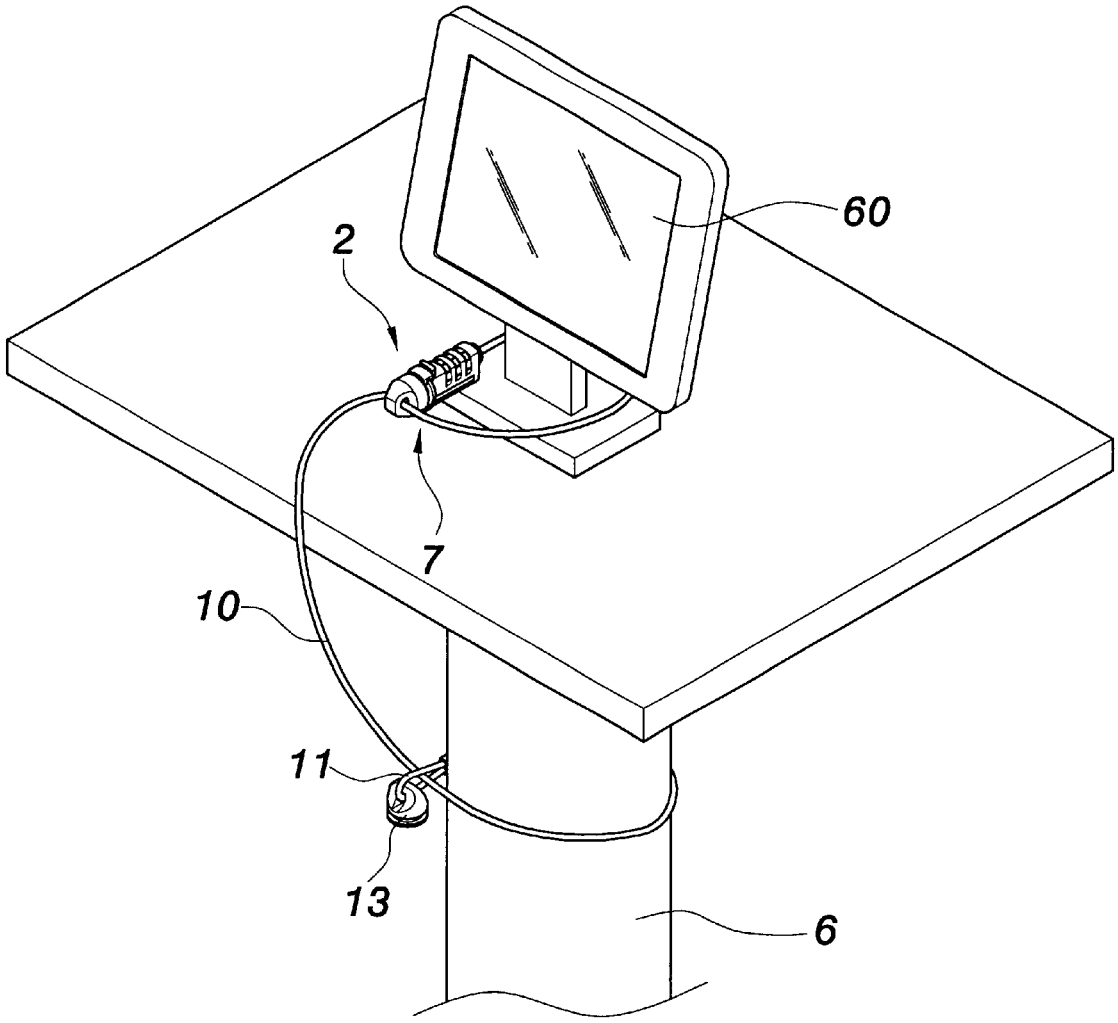
FIG. 10 is a perspective view of the present invention using an adjusting stopper head to lock a display.

FIGS. 9 and 10 show other two different states of use of the present invention. In FIG. 9, the mobile stopper head 13 and the lock body 2 are used to lock a box 55. In FIG. 10, after the cable 10 passes through the ring portion 11 and is then slipped on a post 6, the adjusting stopper head 7 is connected to the lock body 2, hence locking a display 60 of a computer.

To sum up, the present invention exploits the adjusting stopper head 7 to accomplish the winding and fixing functions at any position of the cable 10. Moreover, the adjusting stopper head 7, the locking stopper head 3, and the mobile stopper head 13 will not slide off from the lock body 2. The present invention can have many different embodiments. The present invention not only has the original function of the cable lock 1, but it can perform locking and unlocking action to important articles such as computers through special locating function of the locking stopper head 3 and the adjusting stopper head 7. Additionally, the present invention has a very wide range of application and self-protection effect.

Although the present invention has been described with reference to the preferred embodiment thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

I claim:

1. A multipurpose cable lock comprising:

a cable having a first end and a second end, the first end thereof being wound back to form a ring portion using a cable head gripper;

a lock body joined at the second end of said cable, one end of said lock body having a locking stopper, an outer end of said locking stopper joining a bottom locking edge, said bottom locking edge moving along with said locking stopper, a top locking edge being correspondingly disposed on said lock body, said lock body being capable of letting said locking stopper move; and a locking device located on said lock body, said locking device having a main body with an annular groove at a periphery thereof, said annular groove being fastened between said top and bottom locking edges of said lock body.

2. The multipurpose cable lock as claimed in claim 1, wherein said locking device is a mobile stopper head slipped on said ring portion of said cable, said mobile stopper head having a main body with an ear hole, said mobile stopper head being joined with said ring portion through said ear hole.

3. The multipurpose cable lock as claimed in claim 2, wherein a bottom face of said main body of said mobile stopper head has a raised portion, one end face of each said locking edges of said lock body has a groove, and said raised portion is embedded in said groove of said lock body.

4. The multipurpose cable lock as claimed in claim 1, wherein said locking device is an adjusting stopper head having a main body, said main body having an ear hole to be passed through by said cable, the other end of said main body having a bushing seat connected with said ear hole, said adjusting stopper head further having a bushing, an inner half section of said bushing being embedded in said bushing seat, a peripheral face of the inner half section of said bushing having a locating annular groove, a pin being inserted from a hole in the peripheral face of said main body to the surface of said locating annular groove, the inner half section of said bushing being located in said main body using said pin, the center of said bushing having a locating shaft, the middle section of said locating shaft joined with the inner face of said bushing, the outer half section of said bushing having a ring edge to let an inner end of said locating shaft move to press on said cable situated at said ear hole, an outer end of said locating shaft passing through a central hole of said bushing and then being embedded in a groove disposed on each said locking edge of said lock body.

5. The multipurpose cable lock as claimed in claim 4, wherein said bushing of said adjusting stopper head has an inner thread disposed therein, and the middle section of said locating shaft has an outer thread to be screwed to said inner thread of said bushing.

6. The multipurpose cable lock as claimed in claim 1, wherein said locking device is a locking stopper head having a main body, said main body having a pair of locking feet protruding out from one end face of said main body, one outer end of each said locking foot having a hook head to stick into a fixing hole disposed on a computer housing, one inner end of each said locking foot being pivotally joined in said main body, an axial stopper being sandwiched between said pair of locking feet, said axial stopper being used to let said locking feet unfold and be locked in said fixing hole.

7. The multipurpose cable lock as claimed in claim 6, wherein said inner ends of said locking feet of said locking stopper head have pivots at two sides thereof respectively, said pivots being pivotally joined in a swing room disposed in said main body, a V-shaped opening being formed between backs of said two hook heads, said axial stopper having an outer thread portion thereon, the center of said main body having a corresponding inner thread region, said two locking feet swinging outwards to let said outer thread portion be screwed to said inner thread region when said axial stopper is squeezed into said main body.

8. The multipurpose cable lock as claimed in claim 6, wherein said axial stopper of said locking stopper head has a raised head, one end face of each said locking edge of said lock body has a groove, and said raised head is embedded in said groove of said lock body.

9. The multipurpose cable lock as claimed in claim 1, wherein said locking device is composed of a mobile stopper head and an adjusting stopper head, or a mobile stopper head and a locking stopper head, or an adjusting stopper head and a locking stopper head, or a mobile stopper head and an adjusting stopper head and a locking stopper head.

* * * * *